US005982258A

United States Patent [19]

Baginski et al.

[11] Patent Number: 5,982,258

[45] Date of Patent: Nov. 9, 1999

[54] TRIPPING DEVICE FOR A CIRCUIT BREAKER EQUIPPED WITH AN ELECTRICAL FAULT INDICATION

[75] Inventors: Pierre Baginski, Grenoble; Gilles Budillon, Voiron; Jean-Pierre Nereau, Seyssinet, all of France

[73] Assignee: Schneider Electric SA, France

[21] Appl. No.: 09/233,334

[22] Filed: Jan. 20, 1999

[30] Foreign Application Priority Data

Feb. 9, 1998 [FR] France ..... 98 01719

[51] Int. Cl.[6] ..... H01H 9/00

[52] U.S. Cl. ..... 335/175; 335/17; 335/21; 335/27; 335/42; 335/172; 335/176

[58] Field of Search ..... 335/6, 9, 10, 17, 335/21–45, 167–176; 340/638, 639

[56] References Cited

U.S. PATENT DOCUMENTS 5,714,940 2/1998 Fishovitz et al. ..... 340/638

5,886,641 3/1999 Ulerich et al. ..... 340/638

FOREIGN PATENT DOCUMENTS

3820113 C1 11/1989 Germany .

4013650 A1 1/1991 Germany .

*Primary Examiner*—Lincoln Donovan

*Assistant Examiner*—Raymond Barrera

*Attorney, Agent, or Firm*—Parkhurst & Wendel, L.L.P.

[57] ABSTRACT

The trip bar is sub-divided into a first actuating part associated to the trip rod of the actuator and a second actuating part operating in conjunction with the indicating device. A mechanical coupling link is arranged between the two actuating parts being adjustable between a coupled position and a disengaged position. An operating lever performs locking of the second actuating part in the active position to keep the fault information on the indicating device, whereas the first actuating part returns automatically to the inactive position when said mechanical link is in the disengaged position.

8 Claims, 6 Drawing Sheets

TRIPPING DEVICE FOR A CIRCUIT BREAKER EQUIPPED WITH AN ELECTRICAL FAULT INDICATION

BACKGROUND OF THE INVENTION

The invention relates to a tripping device for an electrical circuit breaker, comprising:

a rotary trip bar cooperating in the active position with an actuator to transmit a tripping order to the mechanism in the event of an electrical fault, an indication device for indication of the fault after the mechanism has tripped, and return means to return the trip bar to an inactive position enabling the circuit breaker to be reclosed.

The electrical fault signal SDE function indicates the nature of the trip on an electrical fault. This involves a mechanical and electrical indication which locks the circuit breaker simultaneously in the open state. Reclosing of the circuit breaker is only possible if the user has previously cleared the locking by returning the indication device to a rest position.

In certain applications, it has already been proposed to reclose the circuit breaker after tripping to ensure continuity of service, while keeping the fault information. Tripping systems known to date are irreversible and have to be customized in the plant when manufactured.

Two types of circuit breakers are then obtained:

either a first type of circuit breaker not enabling reclosing of the contacts so long as indication of the fault has not been cleared;

or a second type of circuit breaker enabling reclosing of the contacts while keeping the fault information.

These two tripping systems complicate plant manufacturing management. In addition, the customer has to make the choice of the type of tripping, according to his requirements, when placing his order.

SUMMARY OF THE INVENTION

The object of the invention is to achieve a tripping device for a circuit breaker with electrical fault indication, enabling the customer to choose the operating mode himself, with or without reclosing of the circuit breaker in the presence of fault indication.

The tripping device according to the invention is characterized in that the trip bar is sub-divided into a first actuating part associated to the trip rod of the actuator, and a second actuating part operating in conjunction with the indicating device, that a mechanical coupling link is arranged between the two actuating parts being adjustable between a coupled position and a disengaged position, and that an operating lever performs locking in the active position of the second actuating part to keep the fault information on the indicating device, whereas the first actuating part returns automatically to the inactive position when said mechanical link is in the disengaged position.

According to one feature of the invention, the mechanical coupling link between the two actuating parts of the trip bar is reversible between the coupled position and the disengaged position, and vice-versa.

According to another feature of the invention, the operating lever is pivotally mounted on a spindle between a first securing position on the second actuating part in the inactive position and a second position performing said locking in the active position. A return spring biases the operating lever to said second locking position after the mechanism has tripped.

According to a preferred embodiment, the mechanical coupling link comprises a male transmission element designed to operate in conjunction with a female element following a relative movement of the two actuating parts in translation. Each actuating part of the trip bar is biased to the inactive position by a return spring. The electrical fault indication device comprises an auxiliary contact controlled by means of a transmission lever when the second actuating part is driven to the active position.

BRIEF DESCRIPTION OF THE DRAWINGS

Other advantages and features of the invention will become more clearly apparent from the following description of an embodiment of the invention, given as a non-restrictive example only and represented in the accompanying drawings in which.

DETAILED DESCRIPTION OF THE PREFERRED EMBODIMENT

Figure 1:
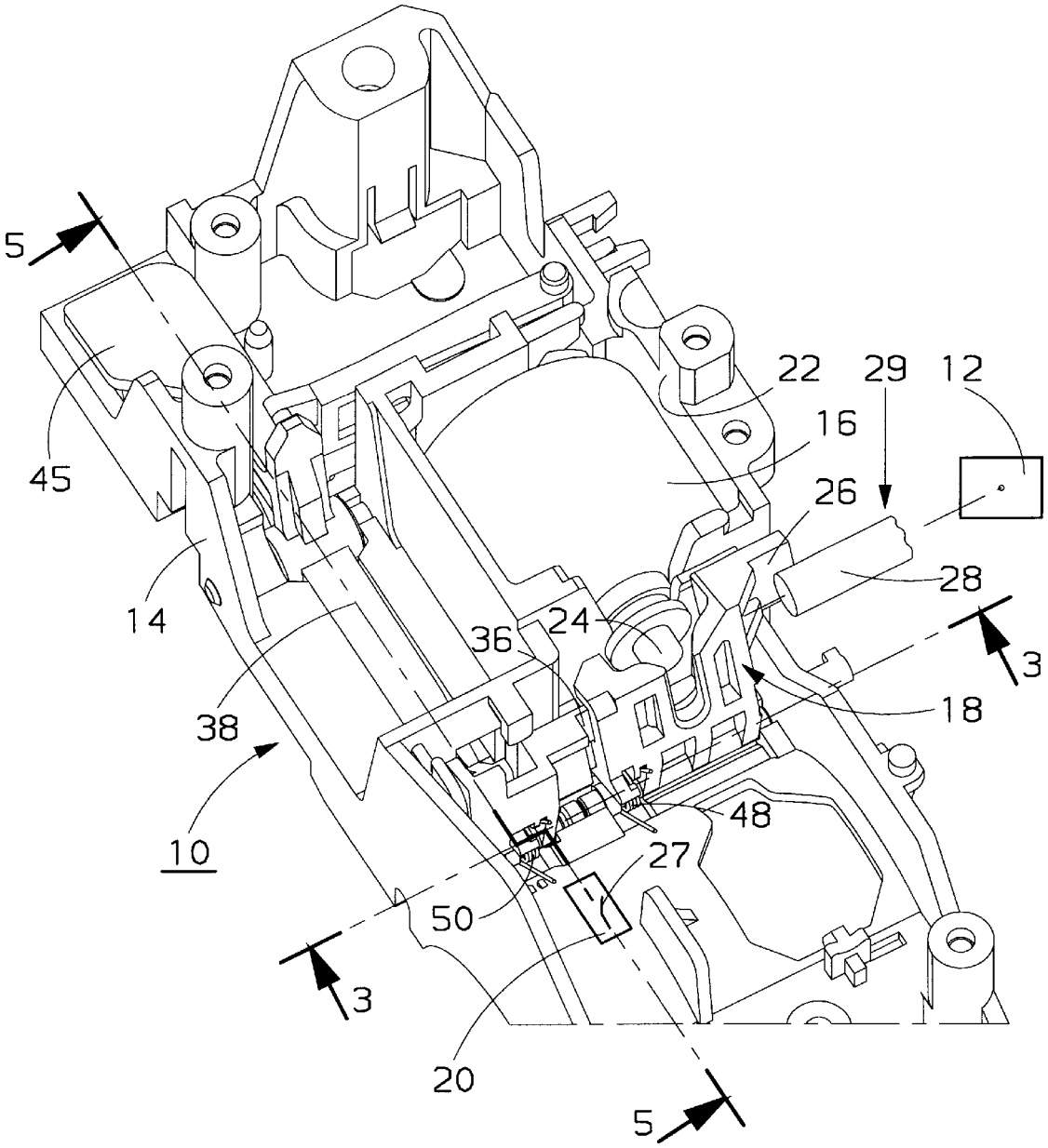
FIG. 1 is a perspective view of the tripping device according to the invention.
Figure 2:
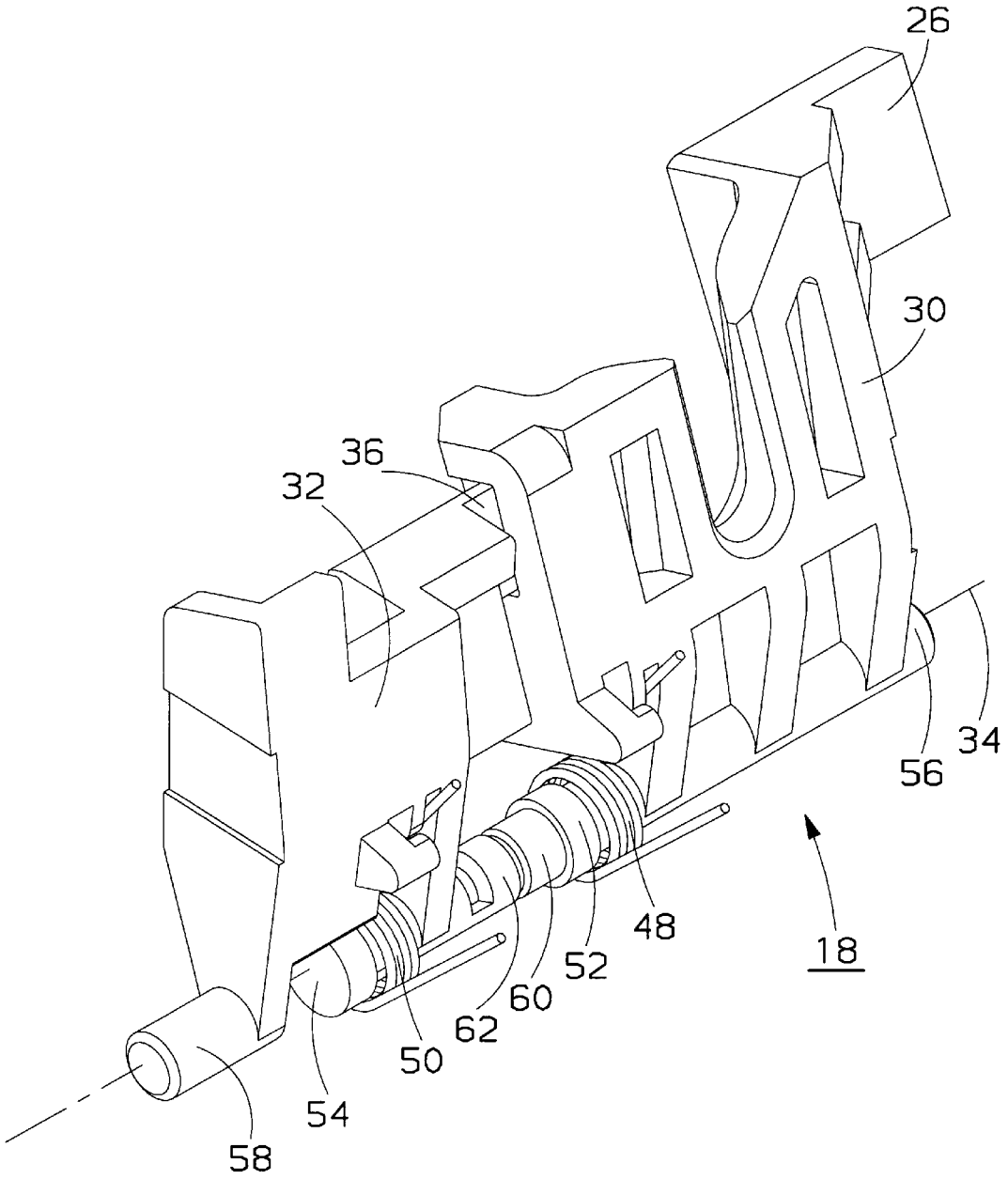
FIG. 2 shows a perspective view on an enlarged scale of the trip bar of FIG. 1.

In FIG. 1 a trip device 10 on an electrical fault is associated to an operating mechanism 12 to bring about separation of the contacts of a circuit breaker when a fault current is detected. The trip device 10 is housed in a case 14 made of molded insulating material containing an actuator 16 operating in conjunction with a rotary trip bar 18, and an indicating device 20 called electrical fault signal SDE.

The actuator 16 comprises an electromagnetic relay located in a compartment 22 of the case 14 and having an operating coil electrically connected to a processing circuit in connection with the current sensors (not represented). The actuator 16 is provided with a magnetic core movable in translation coupled to a trip rod 24 able to occupy a set position or a tripped position, respectively when the coil excitation current intensity is below or above a preset threshold. The relay can be of the type described in the document FR-A-2,573,570, but any other relay could naturally be used. The trip rod 24 of the relay extends perpendicularly with respect to the transverse trip bar 18, which bar is provided with a lateral lug 26 designed to transmit the tripping order to the operating half-moon 28 of the opening ratchet of the mechanism 12. The assembly formed by the lug 26 of the first part 30 and the half-moon 28 constitutes a mechanical tripping link 29 with the mechanism 12.

The indicating device 20 is formed by an auxiliary contact 27 indicating tripping on an electrical fault when the trip bar 18 moves to the active position following operation of the relay.

Figure 3:
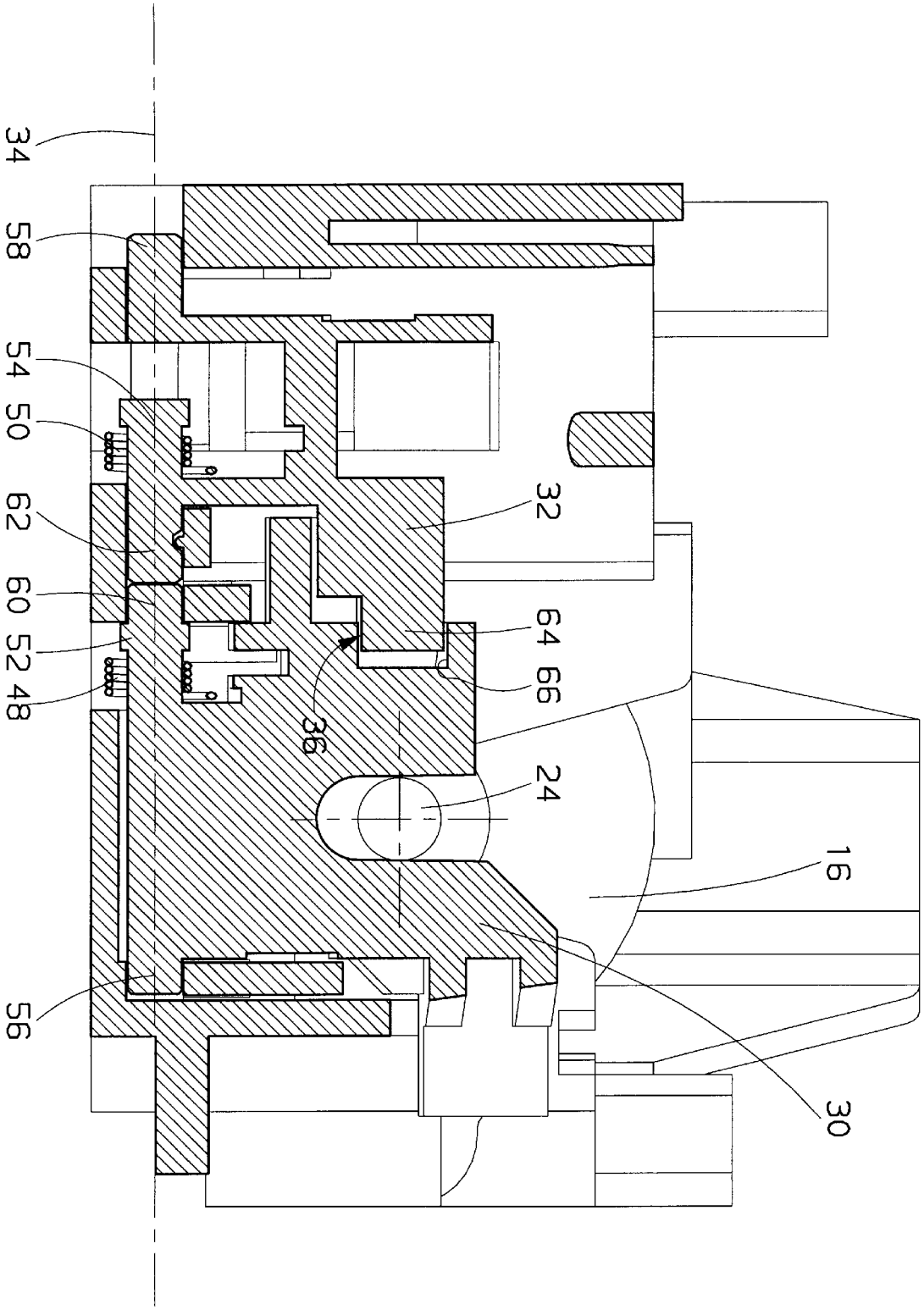
FIG. 3 is a transverse cross sectional view along the line 3—3 of FIG. 1, the mechanical coupling link being represented in the coupled position.
Figure 4:
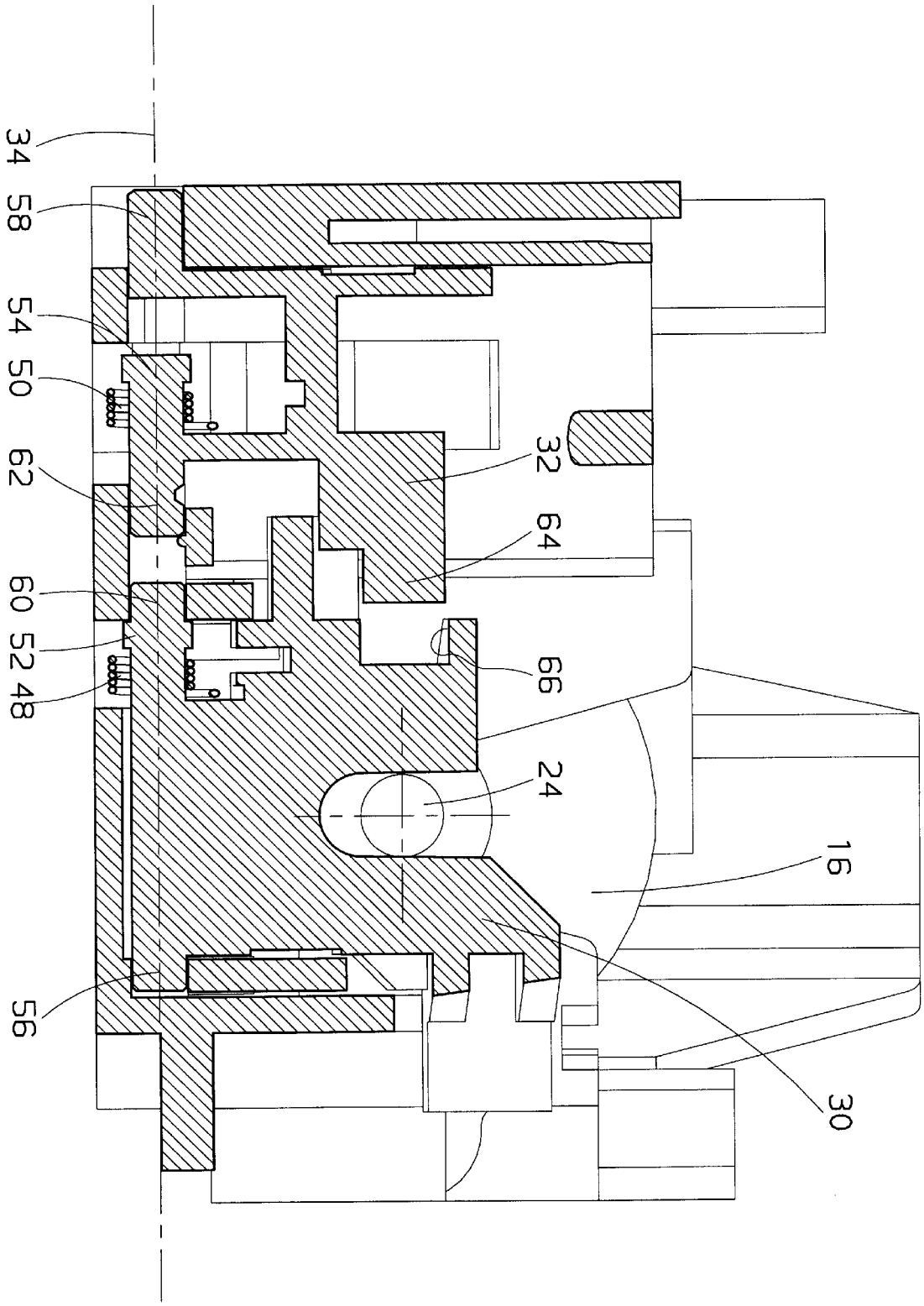
FIG. 4 is an identical view to FIG. 3 with the mechanical coupling link represented in the disengaged position.

With reference to FIGS. 2 to 6, the trip bar 18 comprises two distinct actuating parts 30, 32, mounted in transverse alignment along the rotation axis 34. The two parts 30, 32 are equipped with a mechanical coupling link 36 able to be operated between a coupled position (FIGS. 2 and 3), or a disengaged position (FIG. 4).

In the coupled position , the two actuating parts 30, 32 a resecured to one another and driven simultaneously in rotation so as to form a monoblock trip bar 18, locked in the active position when the actuator 16 moves to the tipped position. Locking of the trip bar 18 is achieved by means of an operating lever 38 operating in conjunction with the second actuating part 32.

Figure 5:
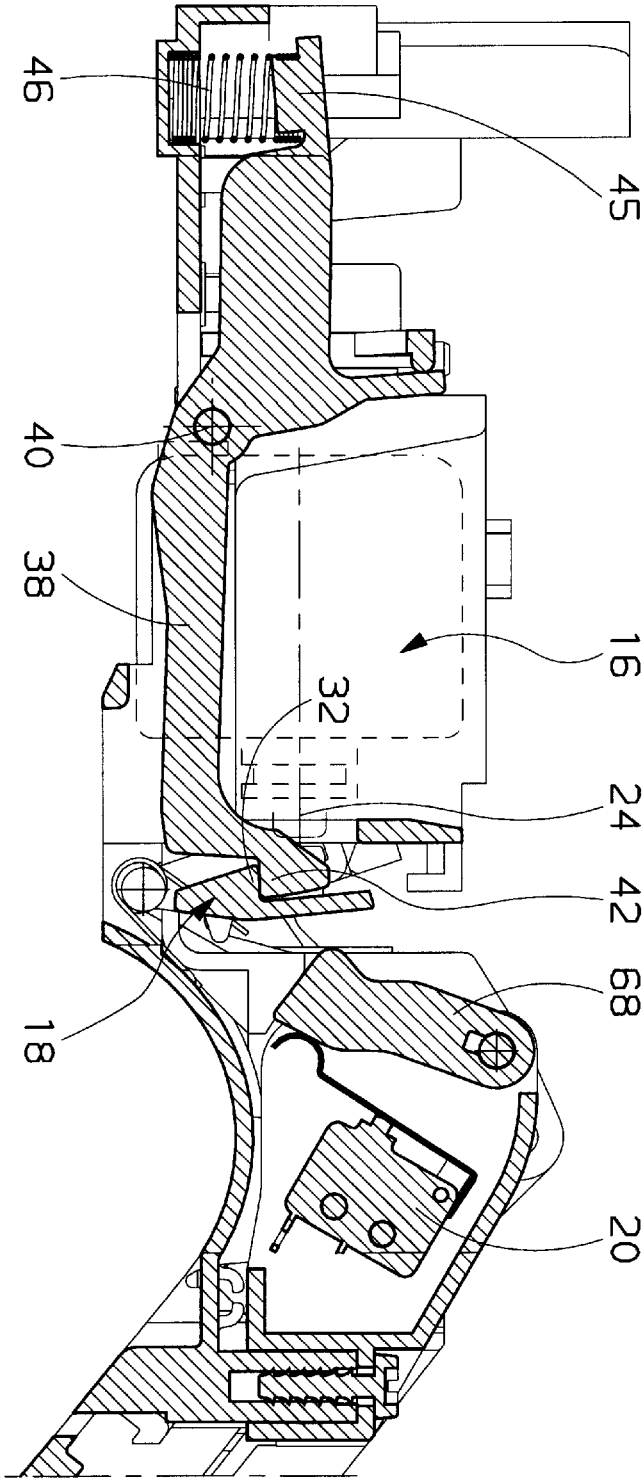
FIG. 5 shows a longitudinal cross sectional view along the line 5—5 of FIG. 1, the trip bar being represented in the inactive non-tripping position.
Figure 6:
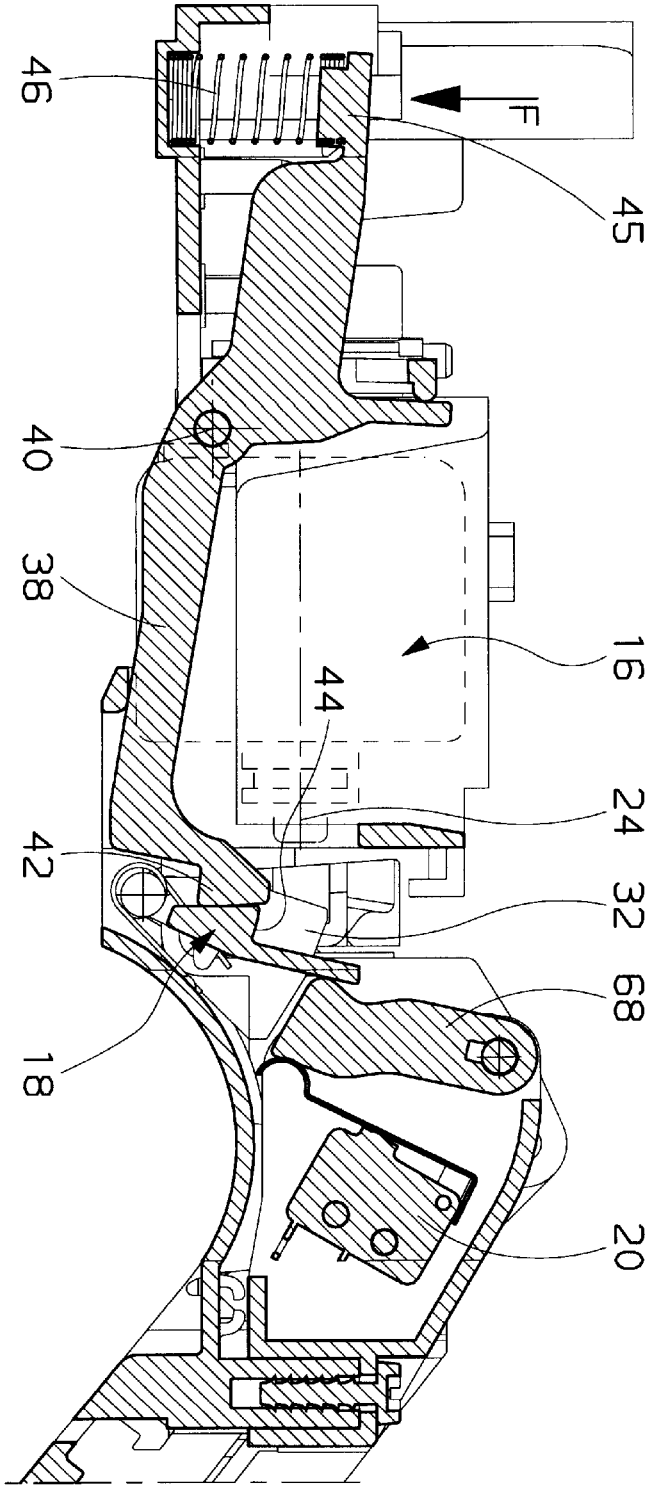
FIG. 6 is an identical view to FIG. 5, after tripping of the device.

The operating lever 38 is pivotally mounted on an intermediate spindle 40 between a first position securing the second part 32 in the inactive position (FIG. 5) and a second position locking the second part 32 in the trip indication position (FIG. 6). One of the ends of the operating lever 38 is provided with a retaining hook 42 operating in the first position in conjunction with a bearing surface 44 of the second part 32 (FIG. 5). The opposite end 45 of the operating lever 38 is subjected to the action of a compression spring 46 which tends to move said lever 38 to the second locking position after the bearing surface 44 has been cleared (FIG. 6).

Each actuating part 30, 32 of the trip bar 18 is biased to the inactive position by a return spring 48, 50 formed by a torsion spring threaded onto a cylindrical end-piece 52, 54 of the corresponding part 30, 32. The first actuating part 30 is provided with a first rotary pivot 56 housed in a bearing on one of the side faces of the case 14.

The second actuating part 32 comprises in similar manner a second pivot 58 positioned in a bearing of the opposite face and aligned with the first pivot 56 to form the rotation axis 34 of the trip bar 18. The end-piece 54 of the second part 32 is extended axially by a half-shaft 62 arranged facing another half-shaft 60 of the first actuating part 30.

The mechanical coupling link 36 comprises a male element 64 secured to the second actuating part 32 and designed to engage by translation in a notch of a female element 66 of the first actuating part 30 to obtain the coupled position (FIG. 3). An opposite translational movement drives the mechanical coupling link 36 to the disengaged position as soon as the male element 64 has left the notch of the female element 66 (FIG. 4).

Operation of the tripping device 10 according to FIGS. 1 to 6 is as follows:

Setting of the mechanical coupling link 36 of the trip bar 18 between the coupled position and the disengaged position, and vice-versa, by the user enables two operating modes of the trip device 10 according to the invention to be obtained.

Coupled position:

The male element 64 is inserted in the female element 66 moving the second actuating part 32 towards the first part 30 (FIG. 3), positioning the two half-shafts 60, 62 in abutment against one another. In the absence of a fault, the trip bar 18 is in the inactive position and the actuator 16 is in the set position. The retaining hook 42 is in contact with the bearing surface 44 of the second actuating part 32 and the spring 46 is compressed.

When a fault current occurs, the rod 24 of the actuator 16 moves to the tripped position driving the first part 30 in rotation and the second part 32 to the active position. The hook 42 is released and the operating lever 38 moves from the first securing position to the second locking position due to the expansion action of the spring 46. The lug 26 of the first actuating part 30 of the trip bar 18 transmits the tripping order to the circuit breaker mechanism 12, and the second part 32 operates in conjunction with the indicating device 20 by means of a transmission lever 68 to perform the electrical fault signal function SDE (FIG. 6). The SDE function indicates to the user the nature of the trip on an electrical fault and the operating lever 38 performs positive locking of the trip bar 18 in the active position. The circuit breaker remains kept in the open state, making any reclosing of the contacts impossible in the absence of a manual or electromechanical operation on the operating lever 38.

For the circuit breaker reclosing operation, the user has to voluntarily clear the locking of the trip bar 18 by pressing (see arrow F in FIG. 6) on the end 45 of the operating lever 38. The two springs 50, 52 move the trip bar 18 back to the inactive position (FIG. 5) and bring about latching of the operating lever 38 in the first securing position. The mechanism 12 then simply has to be operated to close the circuit breaker contacts.

Disengaged position:

Movement of the mechanical coupling link 36 to the disengaged position requires a simple withdrawal action on the second actuating part 32. This setting action can be performed in operation by the user (FIG. 4). In the absence of a fault, the trip device 10 is in the set state of FIG. 5.

When the actuator 16 receives a tripping signal following the occurrence of an electrical fault, the two actuating parts 30, 32 of the trip bar 18 are driven in rotation to the active position, causing tripping of the circuit breaker by means of the mechanical tripping link 29, and indication of the electrical fault by means of the auxiliary contact 27 of the indicating device 20. Driving of the second part 32 in rotation by the first part 30 is one-way in the pivoting direction corresponding to tripping. In the opposite direction to tripping, the link between the two parts 30, 32 is totally broken. The second actuating part 32 remains locked in the active position by the operating lever 38 (FIG. 6), but the first actuating part 30 returns automatically to the inactive position due to the return action of the spring 48. The fault indication SDE remains, whereas the circuit breaker can be actuated to the closed state to provide continuity of service.

The user can thus command reclosing of the circuit breaker after tripping, while keeping the information of the fault which occurred.

Setting of the mechanical coupling link 36 between the coupled position and the disengaged position of the two parts 30, 32 is perfectly reversible. It is thus possible to switch from the coupled position to the disengaged position and to then return to the coupled position depending on the applications required by the user.

It is clear that the male and female elements of the mechanical coupling link 36 can be reversed without departing from the scope of the present invention.

We claim:

1. A tripping device for an electrical circuit breaker, comprising:

a rotary trip bar cooperating in the active position with an actuator to transmit a tripping order to the mechanism in the event of an electrical fault, an indication device for indication of the fault after the mechanism has tripped, and return means to return the trip bar to an inactive position enabling the circuit breaker to be reclosed, wherein the trip bar is sub-divided into a first actuating part associated to the trip rod of the actuator, and a second actuating part operating in conjunction with the indicating device, a mechanical coupling link is arranged between the two actuating parts being adjustable between a coupled position and a disengaged position, and an operating lever performs locking in the active position of the second actuating part to keep the fault information on the indicating device, whereas the first actuating part returns automatically to the inactive position when said mechanical link is in the disengaged position.

2. The tripping device according to claim 1, wherein the mechanical coupling link between the two actuating parts of the trip bar is reversible between the coupled position and the disengaged position, and vice-versa.

3. The tripping device according to claim 1, wherein the operating lever is pivotally mounted on a spindle between a first securing position on the second actuating part in the inactive position and a second position performing said locking in the active position.

4. The tripping device according to claim 1, wherein a return spring biases the operating lever to said second locking position after the mechanism has tripped.

5. The tripping device according to claim 1, wherein the mechanical coupling link comprises a male transmission element designed to operate in conjunction with a female element following a relative movement of the two actuating parts in translation.

6. The tripping device according to claim 5, wherein each actuating part of the trip bar is biased to the inactive position by a return spring.

7. The tripping device according to claim 1, wherein the actuator is formed by an electromechanical relay comprising an operating coil and a mobile core coupled to the tripping rod, which rod extends perpendicularly to the trip bar.

8. The tripping device according to claim 1, wherein the electrical fault indication device comprises an auxiliary contact operated by means of a transmission lever when the second actuating part is driven to the active position.

* * * * *